United States Patent [19]

Wilkinson et al.

[11] 3,956,086

[45] May 11, 1976

[54] ELECTROLYTIC CELLS

[75] Inventors: John Arthur Elton Wilkinson, Fareham; Robert Semple Everett Leslie, Havant; David Michael Glindon, Petersfield; Kendrick Peter Haines, Havant; Keith Baker, Portsmouth, all of England

[73] Assignee: CJB Development Limited, London, England

[22] Filed: May 17, 1974

[21] Appl. No.: 471,144

[52] U.S. Cl. ..... 204/105 R; 204/108; 204/222

[51] Int. Cl.[2] ..... C25C 1/00; C25C 1/12; C25C 7/02

[58] Field of Search ..... 204/105 R–108, 284, DIG. 10, 222

[56] References Cited

FOREIGN PATENTS OR APPLICATIONS 1,194,181 6/1970 United Kingdom ..... 204/284

*Primary Examiner*—R. L. Andrews

*Attorney, Agent, or Firm*—Armstrong, Nikaido & Wegner

[57] ABSTRACT

A process for the electrodeposition of metal onto the particles of a fluidised bed cathode is of particular use in the electro-winning of metals. Agglomeration of particles is substantially avoided by the elimination of sharp corners within the portion of the cell where there is electrodeposition and by the removal of particles from the fluidised bed cathode before they reach a size where they tend to lodge adjacent structural surfaces within the cathode compartment. Flow of electrolyte into the base of the cathode compartment may conveniently be distributed by a porous plate or a "V" shaped trough.

5 Claims, 2 Drawing Figures

ELECTROLYTIC CELLS

BACKGROUND OF THE INVENTION

This invention relates to electrolytic processes using cells which incorporate particulate electrodes and, more particularly but not exclusively, is concerned with electrolytic processes involving the electrodeposition of metal onto the particles of a fluidised bed cathode.

In recent years there have been described particulate electrodes which comprise a number of particles at least the surfaces of which have an electrical conductivity of the order of $10^2\Omega^{-1}cm^{-1}$ or greater and which, when the particulate electrode is in use, are moving so as to be in intermittent contact, either directly or through the agency of intermediate particles, with at least one electrically-conductive member often called the "feeder electrode" by means of which electric current is conducted to the particles which engage in charge transfer reactions with species contained in the electrolyte. The electrical conductivity of the "feeder electrode" is generally of the order of $10^4\Omega^{-1}cm^{-1}$ or greater. These particulate electrodes have been developed in a number of different forms. In one form, a mixture of the particles of the electrode and an electrolyte is pumped through a portion of the cell which contains the feeder electrode and in which the electrode reaction occurs, around a circuit outside this portion and is then returned to the portion for further reaction. In another form, the particles of the electrode remain continuously within the portion of the cell which contains the feeder electrode for the entire length of time during which the particles are allowed to contribute to the electrode reaction, whilst the electrolyte is passed through this portion so as to intermix the particles of the electrode. Often included within this latter form are electrodes which, in operation, comprise an expanded bed of particles formed by an upward flow of electrolyte through the portion of the cell which contains the particles of the electrode. With sufficiently fast flow rates the particles become suspended in the electrolyte and the bed becomes expanded in volume usually by expansion in the vertical direction. In order to achieve uniformity of particle concentration in the horizontal plane it is necessary to produce a pattern of flow of electrolyte that is substantially constant through a horizontal cross-section within the bed of particles. The terminology of fluidised beds has been applied to this situation and many of the properties of fluidised beds are evident in the behaviour of these electrodes which are therefore frequently known as fluidised bed electrodes. The high surface area of a fluidised bed electrode makes possible either the efficient electrolysis of dilute solutions or the use of a high current per unit volume of cell and per unit volume of electrolyte; for example, in copper deposition, apparent current densities up to 3000 $A/m^2$ and more have been used.

Examples of particulate electrodes including fluidised bed electrodes, and their use in various electrochemical processes are disclosed in, for example, British Pat. No. 1,194,181; U.S. Pat. No. 3,180,810; U.S. Pat. No. 3,527,617; U.S. Pat. No. 3,551,207; French Pat. No. 1,500,269 and Canadian Pat. No. 790,933.

In many applications of fluidised bed electrodes, the electrode reaction involves deposition of ions onto the particles or dissolution of the material of the particles. In these applications the dimensions of the particles change with time and there may be provision for removal and replenishment of particles. However, in processes involving the electrodeposition of metal onto the particles of a fluidised bed cathode, i.e., a fluidised bed electrode acting as a cathode, it has been found that when such processes are performed continuously over relatively long periods of time, i.e., under the usual conditions of commercial production of electrolytically-deposited metal, there is a tendency for the particles of the cathode to agglomerate and to adhere to the feeder electrode or to other parts of the cathode compartment. This tendency is detrimental to efficient cell operation on a commercial scale and, if allowed to proceed unimpeded substantially reduces the potentially high value of the use of fluidised bed cathodes in such applications as, for example, metal winning and metal refining.

We have now discovered a manner of performing processes in which there is electrodeposition of metal onto a fluidised bed cathode whilst ameliorating the abovementioned disadvantages.

SUMMARY OF THE INVENTION

According to one aspect of the present invention there is provided a process for the electrodeposition of metal onto the particles of a fluidised bed cathode and within an electroactive region of a cathode compartment of an electrolytic cell, said fluidised bed cathode being fluidised by a flow of an aqueous electrolyte, which process comprises the steps of charging a plurality of metallic particles to a cathode compartment of an electrolytic cell which cathode compartment has been shaped or radiused so that within the electroactive region of said cathode compartment all internal angles between structural surfaces are greater than 90° and are radiused to a radius greater than those of the particles and so that within said electroactive region there are no surfaces of substantially horizontal disposition except such horizontal surfaces over which said flow of electrolyte is such as to displace particles adjacent said surfaces; flowing upwardly through said plurality of metallic particles an aqueous liquid electrolyte in such a way as to fluidise said plurality of metallic particles and form a fluidised bed cathode, said flowing being at a rate sufficient to maintain the volume occupied by the particles at a volume at least 10% greater than the volume they occupy when settled; maintaining an electrical potential difference appropriate to the process between said fluidised bed cathode and a counter electrode in said cell and, removing from the cathode compartment particles which by virtue of their large size tend to form particle bridges between structural surfaces in said cathode compartment.

According to another aspect of the present invention there is provided an electrolytic cell adapted to contain a fluidised bed particulate cathode and comprising a. a cathode compartment having, in use, an electroactive region, b. a counter electrode adjacent said compartment and c. means for flowing upwardly through said cathode compartment an aqueous liquid electrolyte, the cell being constructed so that within the electroactive region of said cathode compartment all internal angles between structural surfaces are of greater than 90° and so that within said electroactive region there are no surfaces of substantially horizontal disposition except such horizontal surfaces over which in use a flow of electrolyte is such as to displace particles adjacent said surfaces.

By the term "electroactive region of the cathode compartment of the cell" which is referred to above and which is used herein is meant that portion of the cathode compartment in which electrochemical action is taking place. In the case of the electrodeposition of metals, the term refers to that portion of the cell in which metal is being deposited on the cathode particles.

DESCRIPTION OF THE PREFERRED EMBODIMENTS

Figure 1:
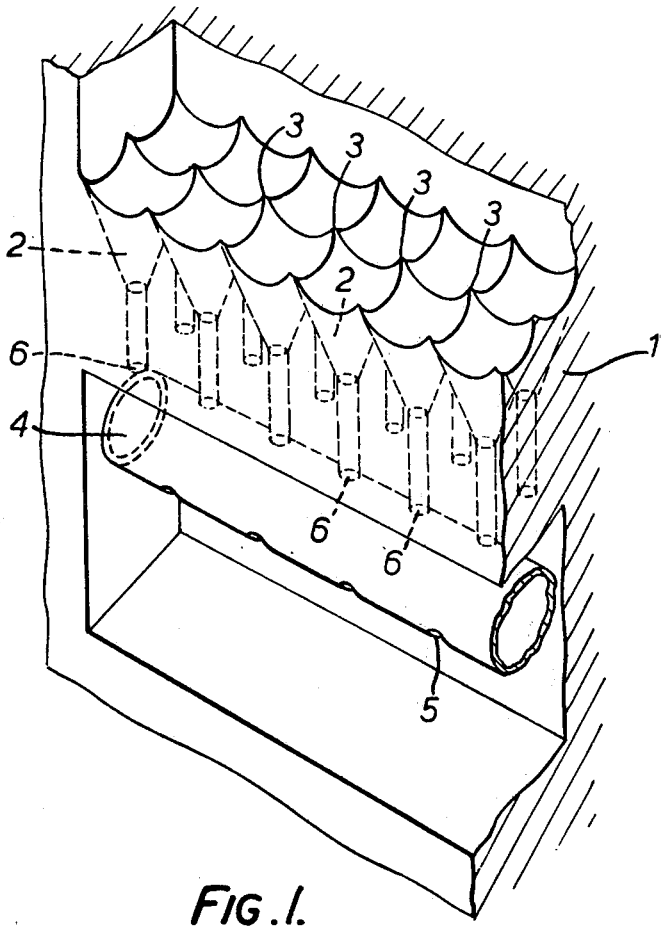
FIG. 1 is a cross-sectional, partial cut-away view of a flow distributor of the present invention.

In the following description the design of an electrolytic cell containing a fluidised bed cathode for the electrodeposition of metal will be explained and discussed and the principal factors affecting its efficient operation will be explained.

Considering firstly the general structure of an electrolytic cell containing a fluidised bed cathode, the cell will usually be separated into two compartments (namely an anode compartment and a cathode compartment) by means of a diaphragm. The diaphragm prevents the particles from short circuiting the electrolytic cell, and enables different process streams to be passed through the anode and cathode compartments. Ion transport through the diaphragm is essential although in general fluid flow through it must be minimised, because such flow interferes with the fluidisation of the cathode particles. The preferred materials for use as diaphragms are low permeability diaphragms; there can also be used ion exchange membranes (anionic or cationic) which are ion permeable but nonporous.

In one embodiment of an electrolytic cell in accordance with the invention, the cell and electrode compartments are basically rectangular in section and parallel to the diaphragm. The exterior faces are plain, so that cells can be packed closely together thus reducing the need for structural support and all electrical and pipework connections are made through the top or edges of the cell. The cells may, if required, be constructed in a plate filter press type arrangement.

For the purposes of description of the electrolytic cell and cell components in this specification "height" is in the vertical dimension, "thickness" is in the horizontal dimension perpendicular to the plane of the diaphragm and "width" is in the horizontal dimension parallel to the diaphragm.

Regarding the dimensions of the cathode compartment of the cell which contains the fluidised bed cathode, we know of no theoretical restrictions on the height and width of the fluidised bed cathode. The only restrictions are likely to result from the available size and strength of cell component and the economics of producing small or large cells. A useful size of cell is one in which both the height and width of the fluidised bed cathode are approximately 1 metre.

The thickness of the cathode compartment which contains the fluidised bed cathode is important. It has been shown that when particles grow larger than a certain size they tend to form particle bridges between structural surfaces in the cathode compartment. Our practical experience suggests that to prevent such bridging there is required a minimum distance between any structural surfaces within the compartment. If this minimum distance is not maintained in electrodeposition processes particle bridges may be formed which can give rise to particle agglomeration and dendritic growth. The minimum distance is at least six times the diameter of the largest cathode particles present in any number, although the preferred dimension is ten such particle diameters. If, for example, the feeder electrode is located in the middle of the cathode bed the thickness of the cathode compartment will be a minimum of twelve particle diameters plus the thickness of the feeder electrode. It will be understood that by the term "present in any number" we mean particles of a diameter (within a range of ± 10% of that diameter) which constitute at least 5% by weight of the total weight of the particulate bed. It will be realised that in practice, particularly in a continuous process where the electrolytic reaction is one of deposition on to cathode particles, the largest electrode particles present in any number will be particles of product which are suitable for extraction from the cell. The minimum distance requirement can therefore readily be met by extracting product particles before they have grown to a size which would conflict with this requirement.

We know of no theoretical maximum thickness for the fluidised bed electrode compartment. However, increasing the thickness and keeping the feeder in the middle of the bed will result in an increased cell voltage, an increased pumping cost and, for example in the case of copper extraction or purification will require an increased inventory of copper.

Regarding the shape of the compartment one possible shape for the fluidised bed cathode compartment is rectangular with the sides of the compartment perpendicular and parallel. This configuration is useful for beds where all the particles lie within a narrow size range (say ± 10% of mean diameter) as the extent of bed voidage will be effectively constant throughout the height of the bed.

With particles having a wide size distribution and good flow distribution in the bed, stratification will take place with the larger particles at the base of the bed. In a parallel sided cell this results in the extent of bed voidage increasing as the particle size decreases. Interparticle contact and current distribution are therefore adversely affected. One method of correcting this phenomenon is to provide a cell design in which the horizontal cross section of the cathode compartment increases uniformly with height. In this way the voidage throughout the bed can be maintained within acceptable limits. To ensure good flow distribution throughout the bed the angle of taper should not exceed 15° from the vertical and is preferably as small as possible. The height of the bed, angle of taper, particle size range, and voidage range are all inter-related with the result that there is no ideal shape or size of cell which can be used for all processes.

An alternative cathode compartment shape combines the properties of the configurations described above, in so far as it contains both a vertical and an inclined section, and is potentially particularly useful in the continuous deposition of metal from solution such as in the winning of copper from leach liquors. In a continuous metal deposition process the cathode particles grow and it is necessary therefore to add small particles to the cathode compartment and remove large particles as product. Under steady state conditions the number of particles added to the cathode compartment must over a period be approximately the same as the number of particles removed from the cathode compartment and the large particles contained in the cathode compartment will occupy a large percentage of the total bed volume. A particularly useful cathode compartment shape therefore is one in which the lower portion is parallel sided and the upper portion is tapered. Large particles of narrow size range occupy the lower portion and voidage is maintained approximately constant and smaller particles of wide size range occupy the upper portion of the compartment where tapering ensures that the voidage at all heights is acceptable.

As mentioned above, when a fluidised bed cathode is used for electrodeposition of metal, problems arise due to the fact that if any particles become static within the electroactive region of the bed then agglomeration of particles and dendritic growth of electrodeposited metal will usually result and these processes are detrimental to efficient cell operation. Apart from at particle bridges, there are three other regions in which particles may become static. These are at the edges and corners of the cathode compartment where particles may become trapped at vertical surfaces (particularly the feeder electrode surface) where small particles may come to rest within or partially within the surface boundary layer of electrolyte, and at horizontal surfaces. Horizontal surfaces are only likely to occur on the feeder electrode or at the base of the compartment and these cases are discussed below. In addition sharp edges and corners within the cathode compartment are eliminated by shaping or radiusing the internal surfaces of the compartment so that for example the sides of the compartment meet the diaphragm and the back of the cell at a greater internal angle than 90°. The larger the angle the better, and angles of greater than 120° are preferred. In addition, it has been shown that particles are not "trapped" within the surface boundary layer around the feeder electrode if they are above a minimum size. For example it has been shown that with copper particles of size range 420–500 μm, particles rested against the feeder electrode and eventually became incorporated into the copper deposit on the feeder electrode. With particles of size 500–600 μm this did not occur.

With beds of wide particle size range, say 500 μm to 1200 μm and in which the number of particles in each size range (500–600 μm, 600–710 710 μm, 710–850 μm, 850–1000 μm and 1000–1200 μm) was approximately the same, then 420–500 μm particles in the same number could be incorporated but smaller particles than this could not be incorporated without being trapped as described above. It may be possible with careful design of a cell and control of the operating conditions to utilise metal feed particles as small as 100 μm and to deposit metal on these particles until they have grown to as large as 5 mm diameter. It will be understood therefore that in operating a cell in accordance with the present invention due regard must be paid to these particle size considerations.

The distribution of the flow of catholyte into the base of the cathode compartment is also important. The exact design of flow distributor may depend upon the specific process being carried out. The essential features of any flow distributor for use in the invention must be that it provides substantially uniform flow distribution across the width of the cathode compartment and, in the case of metal deposition, no horizontal surfaces in the electroactive region. Substantially uniform flow distribution may generally be achieved by ensuring that the pressure drop across the flow distributor is of the same order as the pressure drop across the fluidised bed cathode. In certain flow distributor designs a predistributor sparge pipe is included but its provision is not always essential.

The following are examples of types of flow distributors which may be employed.

a. V section with holes

The inlet is essentially a single row of holes located fairly centrally along the width of the base of the cell. The row of holes lies at the base of a V shaped section which meets the rear face of the compartment and the diaphragm at an internal angle of 160° or greater. This type of flow distributor is described hereinafter in more detail with reference to FIG. 2 of the accompanying drawings.

b. Overlapping countersunk holes

FIG. 1 of the accompanying drawings illustrates a cross-sectional, part cut-away view of a flow distributor of this type positioned in the cathode compartment of an electrolytic cell.

The flow distributor is a thick perforated plate 1 with holes 2 uniformly distributed. The holes are countersunk so that each hole overlaps with each of its neighbouring holes. The top surface of the plate is thus a series of spikes 3 and all horizontal surfaces are eliminated. When this type of flow distributor is in use, catholyte flows through a sparge pipe 4 which has perforations 5 arranged to distribute the flow of catholyte evenly along its length. The catholyte then enters the base of the holes 6 and passes through the flow distributor into the cathode compartment of the cell.

c. Porous Plate

The flow distributor may be simply a flat porous plate permeable to electrolyte and positioned across the whole base of the electrode compartment. As the electrolyte flow can be regarded as passing through the plate at every point it is difficult for particles to become static on the plate. The pores of the plate are however very small and subject to blockage and this flow distributor therefore is only suitable for filtered electrolytes.

d. Particulate bed

A particulate bed, whether static or fluidised is itself a good flow distributor. The catholyte flow may be introduced through a simple sparge pipe which acts as a predistributor. The feeder electrode terminates some way above this sparge pipe so that the particulate bed just above the sparge pipe is not electroactive and so this portion of the bed acts solely as the flow distributor. If any particles in this region or around the sparge pipe are static no deleterious effects result.

The particles which make up this section of the bed may be of the same material as the electroactive region of the bed. Alternatively they may be of a different material which may be electronically conducting, semiconducting or non-conducting.

It should be noted that a fluidised bed electrode may be operated under conditions of regular flow as long as such flow is sufficient to fluidise the bed and keep every particle in motion relative to its surroundings for most of the time yet not so great that electrical conduction through the electrode particles is inhibited.

The flow distribution of the catholyte into the cathode compartment of the cell must provide an expansion in height of the bed of particles of at least 10% of the height of the bed when stationary. In many instances a bed expansion of at least 20% of the height of the bed when stationary will be preferred, and the flow distributor for inflow of the catholyte must be carefully selected in order to achieve this.

Another important factor in the design of commercially viable cells containing fluidised bed electrodes is that it is as important to remove the electrolyte uniformly across the width of the cell as it is to introduce it uniformly. This may be easily done by causing the electrolyte to flow over a weir built into the cell, and thence to outlet pipes.

Turning to the design of feeder electrodes for use with fluidised bed cathodes, in view of the restriction on horizontal surfaces in the cathode compartments of cells for metal deposition there are only a limited number of feeder electrodes which can be employed, e.g., planar vertical sheets and vertical rods, tubes or bars.

Planar sheets if suspended in the middle of the fluidised bed cathode screen the particles between them and the rear of the cell, inhibit particle movement and may cause streaming of the catholyte preferentially up one side of the feeder electrode. Planar feeder electrodes are therefore preferably attached to the rear face of the compartment so that particles are not trapped between the electrode and the cell body.

The vertical rod type feeder electrode consists of a series of rods connected to a cross member (e.g., a bus-bar) above the fluidised bed cathode. The rods hang vertically in the cell and are shaped so as to prevent the formation of particle bridges between the rods themselves and between the rods and the walls of the cathode compartment. It is important that the rods are of such a material and of such a cross-section that they do not bend freely and thus do not approach any other solid surface within the active region of the bed. The V section flow distributor is convenient in that the rods can be of such a length as to fit down into the V to enable accurate positioning of the feeder electrode. The space within the V is screened and not electroactive so that even if the ends of the rods contact the V there are no harmful consequences.

A variation on this rod type feeder electrode is a feeder electrode which consists of tubes by means of which catholyte is introduced into the compartment. The tubes act as the catholyte flow distributor. The base of the cell may still be a V or similar section for feeder location purposes.

Any one of a wide variety of materials can be used to fabricate feeder electrodes, as long as it is an electrical conductor. Metals are preferred, and usually the metal for the feeder electrode will be the same as that of the particles of the fluidised bed cathode although different metals may be used if, for example, greater rigidity is required in the feeder rods.

In cells in which a metal is being deposited at a fluidised bed cathode, the plating of the metal onto the feeder electrode to some small extent is often unavoidable. One solution is to choose a material for the feeder electrode which is different from the metal being plated so that the plated material may be easily removed. A suitable material may be one which has a different crystalline structure from that of the metal being plated so that the two metals do not readily adhere to one another. An alternative is to choose the same metal so that feeder electrodes which become oversized can be directly combined with the particulate product from the cell.

For processes in which there is no danger of particle agglomeration, horizontal surfaces can be incorporated into the feeder electrode. Materials such as perforated sheet, woven wire, expanded metal etc. can then be used.

In cells in which a metal is being deposited at a fluidised bed cathode it is usually convenient to use the liberation of oxygen as the anodic reaction. The anode compartment tends to become acid and the anode must be able to withstand these conditions. A vertical planar electrode is very convenient because it can easily be used to support the diaphragm and especially so if a non-conducting inert mesh is placed between the anode and the diaphragm to facilitate the removal of the oxygen.

It has been found that titanium coated with noble metals or a noble metal oxide is a suitable material for the anode at the high current densities that are preferred for the cell operation. An example of such a suitable material is platinised titanium. Under certain conditions, particularly if low current densities are used, lead, lead dioxide or other materials are also suitable. In certain cases it may be economically feasible to carry out an anodic reaction other than the liberation of oxygen. In such cases it may be possible to use other anode materials.

The anode compartment should be flooded with an electrolyte which preferably has a low resistivity. A system in which anolyte is distributed to the whole of the width of the base of the cell such that it flows upwards is to be preferred.

With a fluidised bed cathode where metal is being deposited it is necessary to remove large particles from the cell as product. The particles may be siphoned out, pumped out or simply drained out from near the base of the compartment. If the point of removal is within the active region then a piston type valve is required such that when closed the face of the piston marries with the interior surfaces of the electrode compartment. In this way there is no pipe or protrusion in or on which particles may come to rest. However, if the point of removal is below the active region, the particles may rest in a pipe without deleterious effects. In this case a piston type valve is not obligatory and a simple valve system may be employed. With both of these systems there is a danger that particles may jam the valve and it is as well to flush the particle removal system pipework before closure of the valves.

An alternative method of particle removal is provided by a combination of a suitable feeder electrode and a flow distributor. A suitable arrangement is one in which the feeder electrodes and their support/connector are hollow. In this way the support/connector acts as a sparge pipe and supplies catholyte through the tubes of the feeder electrode. In order to remove particles the flow in one or more of the feeder tubes may be reversed by a suitable arrangement of valves and particles siphoned or pumped out of the cathode compartment via these tubes.

Other general considerations affecting the design of the cell are that it is important that the cell body and flow distributor, are constructed of an insulating material or insulated metal. Similarly that portion of the feeder electrode not immersed in the fluidised bed should preferably be insulated or screened.

Insulation of the feeder electrodes may be accomplished by coating them with a non-conductive film or sleeve. Alternatively, the anode or diaphragm may be screened so that the fluidised bed is divided into electroactive and nonelectroactive regions. Such a screen may be built into the cell body or, in the case where a platinised titanium anode is used, the platinum coating can be omitted so that in this area the anode becomes non-conducting.

Should it be required that the cell be operated under anaerobic condition it is a relatively simple matter to close the top of the electrode compartment by means of a plate, such that the electrolyte is not exposed to the atmosphere.

Figure 2:
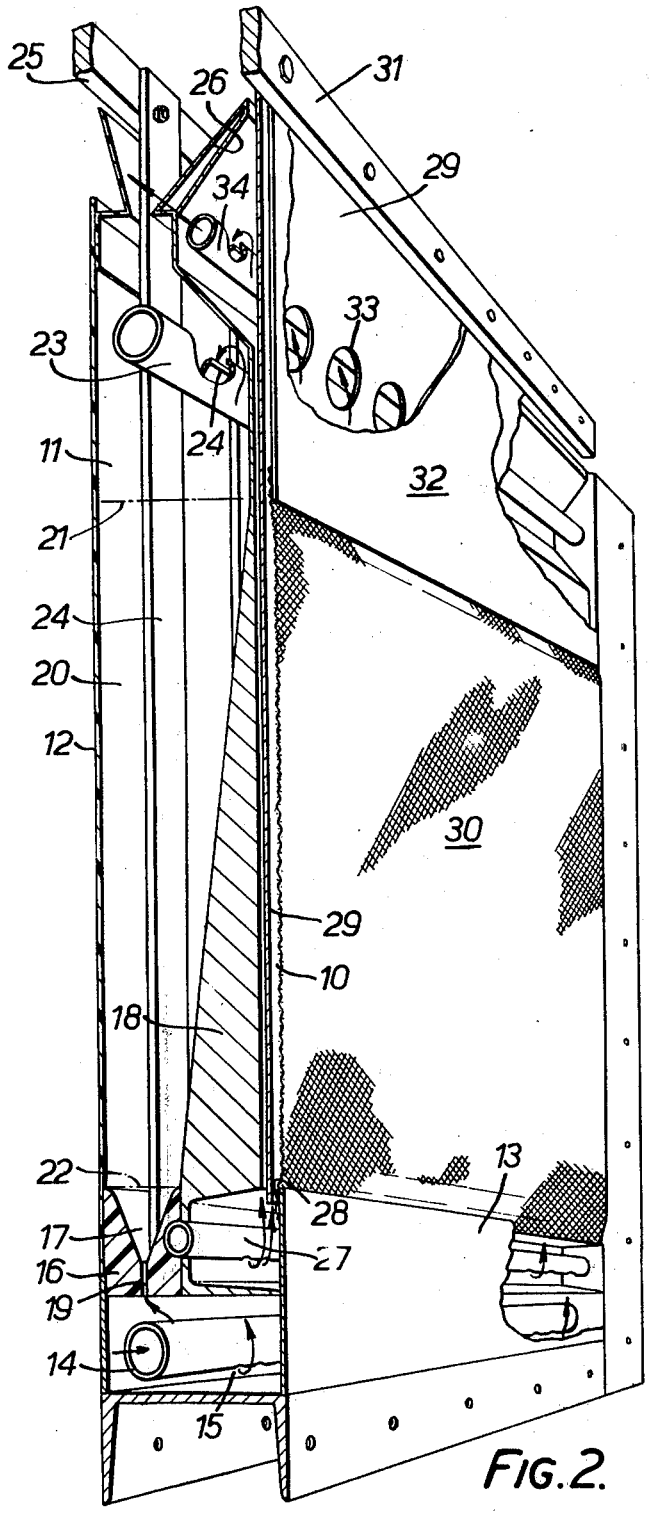
FIG. 2 is a cross-sectional, partial cut-away view of a module according to the present invention.

The features of the present invention will be further described in detail with reference to FIG. 2 of the accompanying drawings which is a cross-sectional, part cut-away perspective diagram of a module which is a part of a multicell arrangement. This particular design is suitable for the electrowinning of copper whereby copper is electrodeposited onto a fluidised bed cathode (this being the working electrode) from an acidic cupric sulphate catholyte. The following description will refer to this particular process.

Referring to the drawing, the module essentially consists of an anode compartment 10 and a cathode compartment 11 arranged back to back so that when numbers of them are assembled with diaphragms, e.g., diaphragm 12, between them a series of cells is so formed. The module body 13 consists essentially of a construction of mild steel. The surfaces of the module body are coated with an electrically insulating and corrosion resistant material. The module body separates the anode compartment and the cathode compartment and isolates the anolyte and catholyte flow systems from one another. Within the cathode compartment the internal angles at which all surfaces meet are greater than 90°.

Catholyte enters through the side of the cathode compartment via a sparge pipe 14 which has perforations 15 arranged along its length to ensure even catholyte flow distribution. Catholyte then passes through the flow distributor 16. The uppermost part 17 of the flow distributor is of V shaped cross-section which meets thee diaphragm 12 and the compartment separator 18 at an internal angle of 160° or greater. The angles between the faces of the V is 40° or less, although the faces do not actually meet along a line. If the faces did meet particles would become wedged in the V; instead the base of the V is either a flat strip of a thickness just greater than the largest particle present or a curve of larger radius than that of the largest particle present. Holes 19 are placed centrally along this strip or curve. For a fairly wide cathode compartment the holes may be distributed uniformly, but with a narrow cathode compartment edge effects become pronounced and it may be necessary to have more holes towards the edges of the compartment.

The distribution of the catholyte which flows upwards into the particulate bed cathode 20 contained in the cathode compartment 11 is such that satisfactory fluidisation is maintained, for example typically a 20% expansion of the bed. Sufficient copper powder is present within the cathode compartment to at least fill the electroactive region of the compartment, the limits of which 21 and 22 are shown in FIG. 3. The cathode compartment is tapered in such fashion that copper particles may be grown from 0.5 to about 2 mm in diameter before removal of such particles is necessary. The cathode compartment thus tapers from about 100 mm at its upper end to about 50 mm at its lower end over a height of about 1.5 metres. Sufficient room is allowed in the cathode compartment above the electroactive region to accommodate an increase in volume of the bed as copper is electrodeposited.

The catholyte outlet pipe 23 is made from a non-conducting material and is supported across the width of the cathode compartment. A slit 24 is cut in the top of the part of the pipe which is in the cell and acts as a double weir. The catholyte is thus removed uniformly across the width of the cell and this aids the distribution of catholyte flow within the fluidised bed. The weir pipe is in tension by means of threaded unions which seal against the side of the cell (not shown).

The cathode feeder electrodes 24 are rectangular section copper bars which are supported from a cathode bus bar 25. The lower ends of the feeder electrodes are constrained from horizontal movement by insertion into the V shaped distributor. The feeder electrodes are uniformly spaced along the length of the bus bar to give an even current distribution. A cover 26 is provided at the top of the cathode compartment which is at an angle to the vertical with a slit along its lowermost part. This serves two purposes. First it facilitates the positioning and removal of the cathode feeder assembly by acting as a guide and secondly, it acts as a chute for the addition of small feed particles to the cathode compartment.

Anolyte enters through a sparge pipe 27 and flows through a slit 28 which is connected to the gap between the anode 29 and diaphragm of the adjoining module (not shown). This is partially filled with an expanded plastic mesh material 30 which serves the purpose of supporting the diaphragm against the weight of the fluidised bed cathode of the adjoining module. The anode 29 is a sheet of titanium of which a part is coated in the electroactive region with platinum so as to render that part electroactive. This anode extends above the top of the module where it is connected with the anode bus bar 31. The anolyte flows through a gap between the anode and the anode screen 32 (which is part of the cell structure) and then through holes in the anode 33. Anolyte flows out of the module via an anolyte weir pipe 34. Provision is made for the separation and escape of oxygen which is the product of the anodic reaction.

This design has the advantage of requiring little floor area when large numbers of cells are connected together. In addition, interconnection between adjacent cells requires small quantities of bus bar.

It will also be apparent that packs of cells could be constructed having double sided counter electrodes wherein two fluidised bed cathodes are operated back to back with a double feeder electrode.

The maximum thickness of bed which is electrochemically active may be varied and depends upon the nature of both the cathode material and of the catholyte (size, material, conductivity etc.). However, the preferred thickness of the fluidised bed cathode between the feeder electrode and the diaphragm is of the order of 1 to 3 cm.

It is anticipated that the most useful applications for fluidised electrodes in accordance with this invention will occur in the field of hydrometallurgy. Typical applications are to the winning of metals from leach liquors, effluents and spent process solutions. There are also applications in the electrorefining of impure metals. Such metals include copper, nickel, tin, mercury, zinc and the precious metals. It is accordingly to be understood that the present invention includes within its scope processes for isolating, removing or refining metals whenever employing a fluidised particulate cathode electrolytic cell as described hereinbefore.

What is claimed is:

1. A process for the electrodeposition of metal onto the particles of a fluidized bed cathode and within an electroactive region of a cathode compartment of an electrolytic cell, which process comprises the steps of:

forming said cathode compartment such that within the electroactive region of said cathode compartment all internal angles between structural surfaces are greater than 90° and are radiused to a radius greater than those of the particles and such that within said electroactive region there are no surfaces of substantially horizontal disposition except horizontal surfaces over which said flow of electrolyte is such as to displace the particles adjacent said surfaces;

charging a plurality of metallic particles into said cathode compartment of said electrolytic cell;

flowing upwardly through said plurality of metallic particles an aqueous liquid electrolyte to fluidize said plurality of said metallic particles and form a fluidized bed cathode, said flowing being at a rate sufficient to maintain the volume occupied by the particles at a volume at least 10% greater than the volume they occupy when settled;

maintaining an electrical potential difference between said fluidized bed cathode and a counter electrode in said cell; and, removing from the cathode compartment particles which by virtue of their large size tend to form particle bridges between structural surfaces in said cathode compartment.

2. A process as claimed in claim 1 wherein all said internal angles are greater than 120°.

3. A process as claimed in claim 1 wherein said step of removing particles from said cathode compartment is performed in such a way as to ensure that at all times the diameter of the largest particles present in any number is less than one sixth of the width of the narrowest electrolyte filled gap between any two structural surfaces within said electroactive region of said cathode compartment.

4. A process as claimed in claim 3 wherein said diameter is less than one tenth of the width of said gap.

5. A process as claimed in claim 1 for the electrowinning of copper.

* * * * *